United States Patent [19]

Fukui et al.

[11] 4,030,725

[45] June 21, 1977

[54] PAPER TRAY FOR COPYING MACHINES

[75] Inventors: Kiyoshige Fukui; Akira Tamamura; Minoru Nishimoto, all of Ebina, Japan

[73] Assignee: Rank Xerox Ltd., London, England

[22] Filed: July 27, 1976

[21] Appl. No.: 709,154

[30] Foreign Application Priority Data

Dec. 9, 1975 Japan ..... 50-145911

[52] U.S. Cl. ..... 271/164; 271/171

[51] Int. Cl.[2] ..... B65H 1/22

[58] Field of Search ..... 271/145, 146, 162, 164, 271/171, 220, 223, 224, 169

[56] References Cited

UNITED STATES PATENTS

| | | | |
|---|---|---|---|
| 3,104,872 | 9/1963 | Benson | 271/171 X |
| 3,767,187 | 10/1973 | Mahler | 271/169 |

*Primary Examiner*—Richard A. Schacher

*Attorney, Agent, or Firm*—James J. Ralabate; Clarence A. Green; William A. Henry, II

[57] ABSTRACT

A paper tray for copying machines includes a tray body having a movable side plate and an elastic member operatively connected to the movable side plate whereby as the tray is inserted into a copying machine, the elastic member in cooperation with an actuator on the copier, urges the movable side member against paper placed in the tray and thereby automatically compensates for paper skew as well as paper irregularities.

9 Claims, 5 Drawing Figures

PAPER TRAY FOR COPYING MACHINES

BACKGROUND OF THE INVENTION

This invention relates to improvements in paper trays and more particularly to improvements in paper trays for copying machines.

Conventional copying machines, which use copy paper pre-cut into a given size, are provided with a paper tray in dimension suited to that particular size of paper. However, even with paper of the same dimension pre-cut into a given size, side edges of the paper are pressed against the sides of the paper tray, when they are received in the tray, due to the tolerance when cut, to thereby cause inconveniences such as hampering smooth paper feeding, and in the case of small-sized paper, paper is displaced from its position so that it is fed skewed. In order to overcome such inconveniences as noted above, prior inventions advanced the idea of embodying a paper tray, in which side plates on the tray were made adjustable. However, this paper tray suffered from the drawback that side plates must be adjusted every time paper is supplied and thereby rendered the operation time-consuming as well as cumbersome.

This invention overcomes such disadvantages as noted above and with respect to prior art such as U.S. Pat. Nos. 3,408,064; 3,647,207; 3,664,663; and 3,767,187 and provides a paper tray which is designed so that even if paper should involve irregularities in dimension due to the tolerance of the pre-cut, they would easily be received and positioned to thereby prevent hampering of smooth paper feeding and also to prevent the paper from being displaced.

Accordingly, it is an object of the present invention to provide a paper tray with a movable side plate that automatically adjusts for paper skew as it is inserted into a copier.

Yet another object of the present invention is to provide a paper tray that automatically adjusts for paper skew as well as other paper irregularities.

Yet another object of this invention is to provide a paper tray with a movable side plate and an elastic member connected thereto whereby when the tray is inserted into a copier the elastic member cooperating with an actuator on the machine will move the movable side of the tray in order to compensate for paper skew as well as other paper irregularities.

SUMMARY OF THE INVENTION

In a copier including a detachably mounted paper tray with the paper tray having a movable side therein the improvement is disclosed comprising a camming means operatively connected to said movable side and an actuator means on the copier that is positioned to engage said camming means as the tray is inserted into the copier so that the camming means is urged by the actuator means to automatically move the movable side of the paper tray toward paper within the tray and thereby automatically adjust the paper tray to conform to the size of the paper within the tray.

BRIEF DESCRIPTION OF THE DRAWINGS

For a better understanding of the invention as well as other objects and further features thereof, reference is had to the following detailed description of the invention to be used in conjunction with the accompanying drawings, wherein:

With reference to FIG. 1, there is shown an exemplary container body as 1, which comprises an inner box 2 and an outer box 3. The inner box 2 comprises a bottom plate 4 approximately equal to the size of paper received therein and side plates 5, 6, and 7 uprightly mounted to form three sides with one side being left open. Among these side plates 5 through 7, the side plate 5 has its inner side projectively provided with, for example, two guide raised portions 8 in widthwise spaced relation. The side plate 6 is provided to mount the inner box 2 interiorly of the outer box 3 and has its inner surface provided with two pads 9 to adjust a position of the paper or sheet A. Further, the side plate 7 is designed so that it can be moved to and from side plate 5 with respect to the bottom plate 4. That is, this movable side plate 7 is provided with a bottom member 10 extended into a notch 30 of the recessed bottom plate 4, bottom member 10 being movably mounted on the bottom of the outer box 3 through screws 11. For the purpose of easily moving movable means 7, the bottom of the outer box 3 is formed with slots, with which lower ends of the screws 11 projectively extended from the bottom member 10 are placed in engagement.

Figure 1:
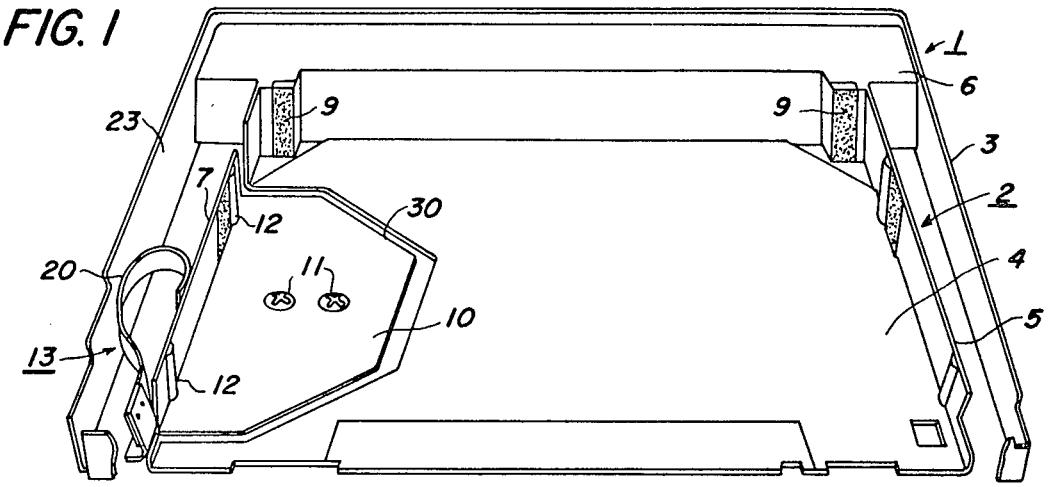
FIG. 1 is a perspective view of the present invention.
Figure 2:
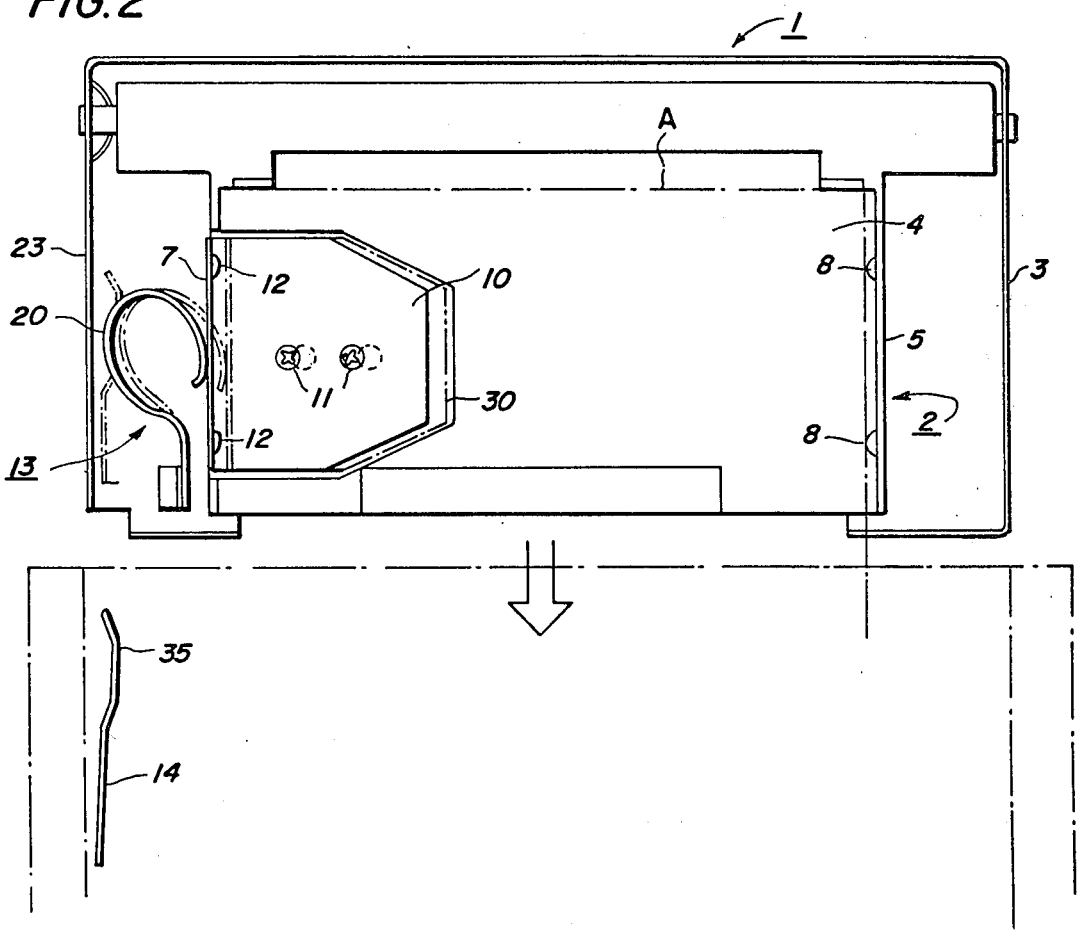
FIG. 2 is a plan view of the present invention.

On the other hand, as is shown in FIG. 2, the movable plate 7 has its inner surface projectively provided with guide raised portions 12 to be positioned opposite the guide raised portions 8 of the aforesaid side plate 5 and is externally provided with an annular or wide looped portion 20 of an elastic member 13 such as a flat spring with the elastic member base portion being fastened to the bottom of the outer box 3. This highly compressible and elastic member or camming means 13 is formed by circularly curving one end side of the flat spring, so that the peripheral surface of the open end side is located adjacent to the movable side plate 7, whereas the peripheral surface of the other side is projectively extended toward a side plate 23 of the outer box 3 so that a tip 35 of an actuator means 14 mounted on the copying machine may come into contact therewith when the container body 1 is inserted into the copying machine.

Figure 3:
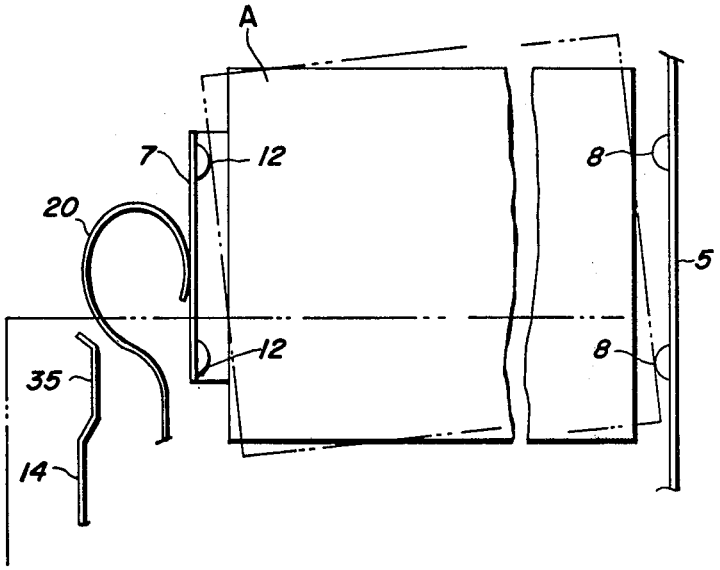
FIGS. 3 through 5 are also plan views that depict operation of the present invention.
Figure 4:
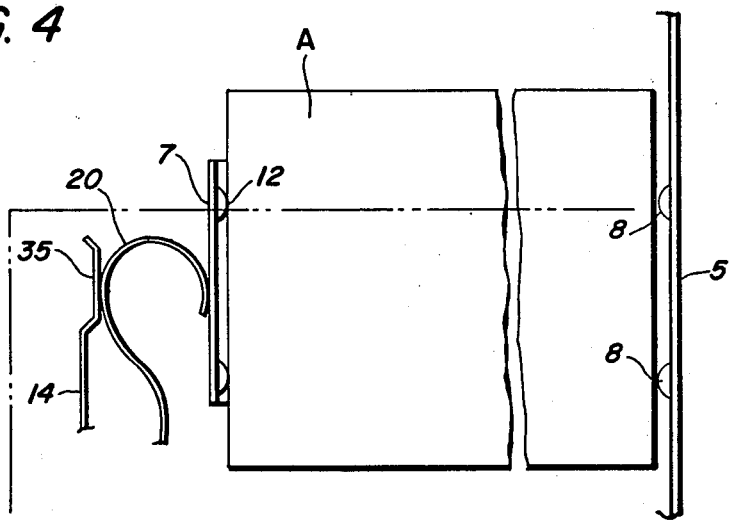
Figure 5:
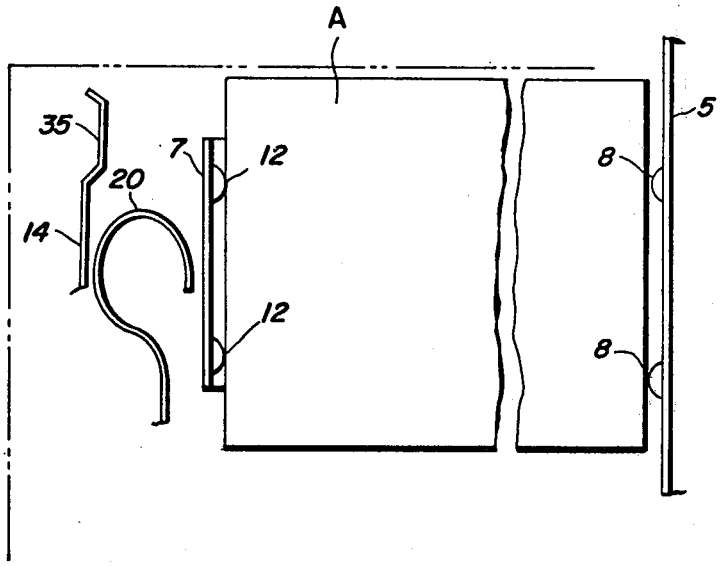

Thus, sheets A to be fed are received within the inner box 2 of the container body 1 removed from the copying machine, as shown in FIG. 3. In this case, a slight displacement of paper A from a given position in the inner box 2 as shown by the dash-dotted contour lines can be allowed. Then, when the container body 1 is inserted into the copying machine, the tip 35 of the actuator means 14 mounted on the copying machine is brought into contact with the annular portion 20 of the elastic member 13 to force or press the annular portion 20 against the movable side plate 7. Whereby the movable side plate 7 in contact with the annular portion 20 of the guide raised portions 12 may come into contact with the side edge of paper A to put paper A in order, as shown in FIG. 4, between the portions 12 and the guide raised portions 8 of the side plate 5. When the annular portion 20 of the elastic member 13 is passed through the actuator 14, the annular portion 20 of the elastic member 13 is moved away from the movable side plate 7 by means of its own elasticity, as shown in FIG. 5, to thereby enable feeding of paper A without applying pressure to the paper.

From the foregoing detailed description, it will be appreciated that in the present invention, since one side of the container body is made to be a movable side plate, even paper with irregularities in size produced as a result of the cutting tolerance of the paper can easily be received, and paper displacement occurring when paper is inserted into the copying machine can also be corrected by the movable side plate through the elastic member being biased by the actuator mounted on the copying machine, thereby preventing skewed-feeding of paper and subsequent paper jams due to the paper displacement. Furher, since the side edge plate after insertion into the copying machine, smooth feeding of paper is not hampered.

In addition to the apparatus outlined above, many other modifications and/or to this invention will be readily apparent to those skilled in the art upon reading this disclosure, and these are intended to be encompassed within the invention disclosed and claimed herein.

What is claimed is:

1. In a copier including a detachably insertably mounted paper tray, said paper tray having a movable sheet side guide therein, the improvement comprising:

camming means operatively connected to said movable sheet side guide; actuator means on the copier positioned to engage said camming means and apply a force thereto as the tray is inserted into the copier, and wherein said actuator means reduces the pressure applied to said camming means automatically once said paper tray is inserted completely into the copier;

said camming means being movable by said actuator means as the tray is inserted into the copier to automatically move said movable sheet side guide of said paper tray toward paper within said paper tray and thereby automatically adjust the paper tray to conform to the size of sheets within the tray when said tray is inserted into the copier.

2. The improvement of claim 1 wherein said camming means comprises a wide looped portion for engaging said sheet at one side thereof and for engaging said actuator means at the opposite side thereof.

3. The improvement of claim 1 wherein said camming means comprises a highly compressible elastic member for providing a wide range of positions of said movable sheet side guide of the paper tray.

4. A paper tray that compensates for paper skew and dimensional irregularities, comprising:

a base plate;

side plates including a movable side plate; an elastic member attached to said movable side plate at one end thereof, said elastic member being actuated by insertion of the tray into a copier to urge said movable side plate toward paper placed on said base plate so as to automatically compensate for skew of the paper placed on said base plate as well as dimensional irregularities in the paper; and said elastic member comprising a wide looped portion for engaging said movable side plate at one side thereof and for engaging an actuator member on the copier on the opposite side thereof.

5. The improvement of claim 4 wherein said elastic member is a spring.

6. The improvement of claim 5 wherein said base plate is recessed.

7. The improvement of claim 6 wherein said base plate is notched.

8. The improvement of claim 4 wherein said elastic member automatically backs away from the paper on said base plate once the tray is inserted completely into a copier so that the paper can be fed from the tray easily.

9. In a copier having a detachably mounted paper tray with said paper tray including a movable side guide, the improved method of compensating for paper skew and irregularities comprising the steps of:

a. inserting the paper tray into the copier; b. applying a force to said movable side guide with a portion of said copier to adjust the paper tray to conform to the size of paper within the tray when said paper tray is inserted into the copier; and c. automatically reducing said force on said movable side guide to thereby allow said movable side guide to back away from paper within said paper tray once the paper tray is inserted completely into the copier so that paper within said paper tray can be fed easily therefrom.

* * * * *